US006421448B1

(12) United States Patent
Arndt et al.

(10) Patent No.: US 6,421,448 B1
(45) Date of Patent: Jul. 16, 2002

(54) HEARING AID WITH A DIRECTIONAL MICROPHONE CHARACTERISTIC AND METHOD FOR PRODUCING SAME

(75) Inventors: Georg-Erwin Arndt, Erlangen; Anton Gebert, Kleinsendelbach; Hartmut Ritter, Neunkirchen, all of (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 0 days.

(21) Appl. No.: 09/548,430

(22) Filed: Apr. 12, 2000

(30) Foreign Application Priority Data

Apr. 26, 1999 (DE) ..... 199 18 883

(51) Int. Cl.[7] ..... H04R 25/00
(52) U.S. Cl. ..... 381/312; 381/92; 381/313
(58) Field of Search ..... 381/92, 312, 313, 381/320, 321, 356, 91, 122, 26, 98

(56) References Cited

U.S. PATENT DOCUMENTS 6,272,229 B1 * 8/2001 Baekgaard ..... 381/92

FOREIGN PATENT DOCUMENTS

EP 0 848 573 6/1998

OTHER PUBLICATIONS

Stephen C. Thompson, Electrical Compensation of the Microphone Sensitivities in a Dual Microphone Directional Hearing Aid, 1999.*

* cited by examiner

*Primary Examiner*—Huyen Le
(74) *Attorney, Agent, or Firm*—Schiff Hardin & Waite

(57) ABSTRACT

In a method for producing a directional microphone characteristic and hearing aid device having a directional microphone characteristic, high-pass filters following two omnidirectional microphones are matched as to their limit frequencies for amplitude response and/or phase response of the two microphones. The limit frequency of the high-pass filter following one microphone is matched to the limit frequency of the other microphone.

16 Claims, 2 Drawing Sheets

HEARING AID WITH A DIRECTIONAL MICROPHONE CHARACTERISTIC AND METHOD FOR PRODUCING SAME

BACKGROUND OF THE INVENTION

1. Field of the Invention

The present invention is directed to a method for producing a directional microphone characteristic in a hearing aid device of the type having at least two input signal paths each with an omnidirectional input transducer and a high-pass filter following the input transducer, a signal pre-amplifying unit, a signal processing unit, a signal output amplifier and an output transducer, with at least two of the input signal paths are interconnected with one another to produce the directional microphone characteristic.

2. Description of the Prior Art

A hearing aid device having two omnidirectional input transducers, referred to in the following also as microphones, is known from European Application 848 573. A series-connected microphone, coupling capacitor and resistor are, respectively, located in two separate signal paths which are interconnected with one another to produce a directional microphone characteristic. In addition, one of the two signal paths has a signal delay unit. A disadvantage of this known circuit is that the desired directional characteristic can be attained only if the two microphones deviate at the most only negligibly from one another with regard to their signal transmission behavior. In the output signal of the two microphones, a phase difference of more that 3° in the frequency range in which the directivity is to be attained already acts negatively on the desired directional characteristic of the arrangement. Only microphones having almost the same signal transmission behavior thus can be used in the known circuit. Since, however, larger manufacturing tolerances cannot be avoided in the manufacture of the microphones, two microphones matching one another, i.e. exhibiting the same signal transmission behavior, must be selected from a larger number of similar microphones. This process is time-consuming and costly.

A circuit is known from the article published in March 1999 "Electrical Compensation of the Microphone Sensitivities in a Dual Microphone Directional Hearing Aid" by Stephen C. Thompson, Knowles Electronics Inc., that enables a correction of the phase difference of the output signals of two microphones inserted into the signal paths of the two microphones. This circuit is, however, complicated and requires additional electrical components in the two signal paths.

SUMMARY OF THE INVENTION

An object of the present invention is to provide a method for producing a directional microphone characteristic in a hearing aid device having two microphones of the same type, that deviate from one another in their signal transmission behavior. In addition, an object of the invention to provide a hearing aid device wherein it is possible, in a simple and economical manner, to achieve a directional microphone characteristic with two microphones of the same type that deviate in their signal transmission behavior.

The above object is achieved in accordance with the principles of the present invention in a method for producing a hearing aid with a directional microphone characteristic, and a hearing aid produced according to the method, wherein at least two omnidirectional microphones are used to receive incoming acoustic signals and wherein each microphone has a signal path connected therewith for processing the signals received by that microphone, the signal paths subsequently being combined to form an overall output signal which is supplied to an output transducer, and wherein each signal path has a high-pass filter therein, with the respective limit frequencies for the high-pass filters being set to match the respective limit frequencies of the microphone in the other signal path. In a hearing aid having two such signal paths, for example, the limit frequency of the high-pass filter in a first of the signal paths is matched to the limit frequency of the omnidirectional microphone which is connected in the second of the two signal paths, and the limit frequency of the high-pass filter in the second of the frequency paths is matched to the limit frequency of the omnidirectional microphone in the first of the signal paths.

The inventive method allows two identical microphones that deviate from one another with respect to their amplitude- and/or phase-response to be matched to one another in a simple and cost-expedient manner such that the desired directional microphone characteristic is attained. For this purpose the values of the coupling capacitors and/or resistors that respectively follow the microphones in the two signal paths of the microphones are adapted to the microphones. In contrast to known devices, there are no additional components to be adapted according to the invention; rather, it suffices either to use components having fixed values adapted to the microphones or to provide components having modifiable values for the capacitors and/or resistors and to subsequently match these, e.g. via programming, to the microphones used. A coupling capacitor and a series-connected resistor are customary coupling-in a microphone output signal and, consequently, are not additional components. The signal behavior of a coupling capacitor and a resistor in the described manner conforms to a high-pass filter.

Microphones customarily used in hearing aid devices nowadays represent acoustic high-pass filters in their signal transmission behavior. The limit frequency of such a high-pass filter, i.e. the frequency at which the magnitude of the output signal divided by the magnitude of the input signal equals −3 dB, is about 100 Hz. To reach this limit frequency, each of the microphones used has a small hole in its membrane, causing the limit frequency—dependent on the diameter of this hole in the membrane—to be shifted to higher values. This shift is necessary to suppress interference signals of lower frequency, as occur in a car, for example, which otherwise could easily lead to over-amplification in the hearing aid device.

Consequently, an acoustic signal undergoes a filtering in two successive high-pass filters and is correspondingly changed as a result in its amplitude response and phase response.

In a directional microphone arrangement, it is necessary for the signal paths of the individual microphones—in particular for low frequencies—to not only match the amplitude responses, but also, above all, the phase responses that are determined very strongly by the limit frequency of the successive high-pass filters.

The amplitude and/or phase balancing of two omnidirectional microphones of the same type, the signals of which are appropriately interconnected for producing a directional microphone characteristic, is attained in the invention by balancing their limit frequencies. This occurs in a particularly simple manner for two microphones that together form a directional microphone, by matching the limit frequencies of the high-pass filters following the microphones, formed by at least one coupling capacitor and a resistor, to the limit frequencies of the microphones, in such a manner that limit frequency of the microphone of one signal path corresponds to the limit frequency of the high-pass filter (following the microphone) of the other signal path.

In an embodiment of the invention, the setting of the limit frequencies of the high-pass filters following the microphones ensues by adjusting the capacitor and/or resistors having variable values. This has the advantage that the capacitors and/or resistors do not have to be specified before the hearing aid device is assembled. In addition, a subsequent readjustment is possible.

The values of the variable resistors and/or capacitors roughly correspond in orders of magnitude to the values of the non-variable resistors and/or capacitors in hearing aid devices according to the prior art. Consequently, they can be realized and integrated into the circuit without difficulty.

In another embodiment of the invention, the limit frequencies of the high-pass filters following the microphones are set by correspondingly programmable resistors and/or capacitors. Thus the microphones can be balanced in a simple manner by programming the hearing aid device. The setting of the limit frequencies can ensue based on the data of the microphone manufacturer regarding the limit frequency of the respective microphone; it can also be implemented at an adjustment station suitable therefor.

Since, e.g. a change in the resistance values influences the subsequent signal amplification, an adaptation of the amplification is necessary to restore the desired weighting of the two signal paths as they merge. In addition, the signal path having the delay element includes an attenuation element following the delay element, preferentially in the form of a variable value resistor.

The invention is employable for all hearing aid embodiments and technologies, e.g. for behind-the-ear or in-the-ear hearing aid devices or implantable hearing aids that can be constructed in analog or digital circuit technology or in hybrid forms.

DESCRIPTION OF THE PREFERRED EMBODIMENTS

Figure 1:
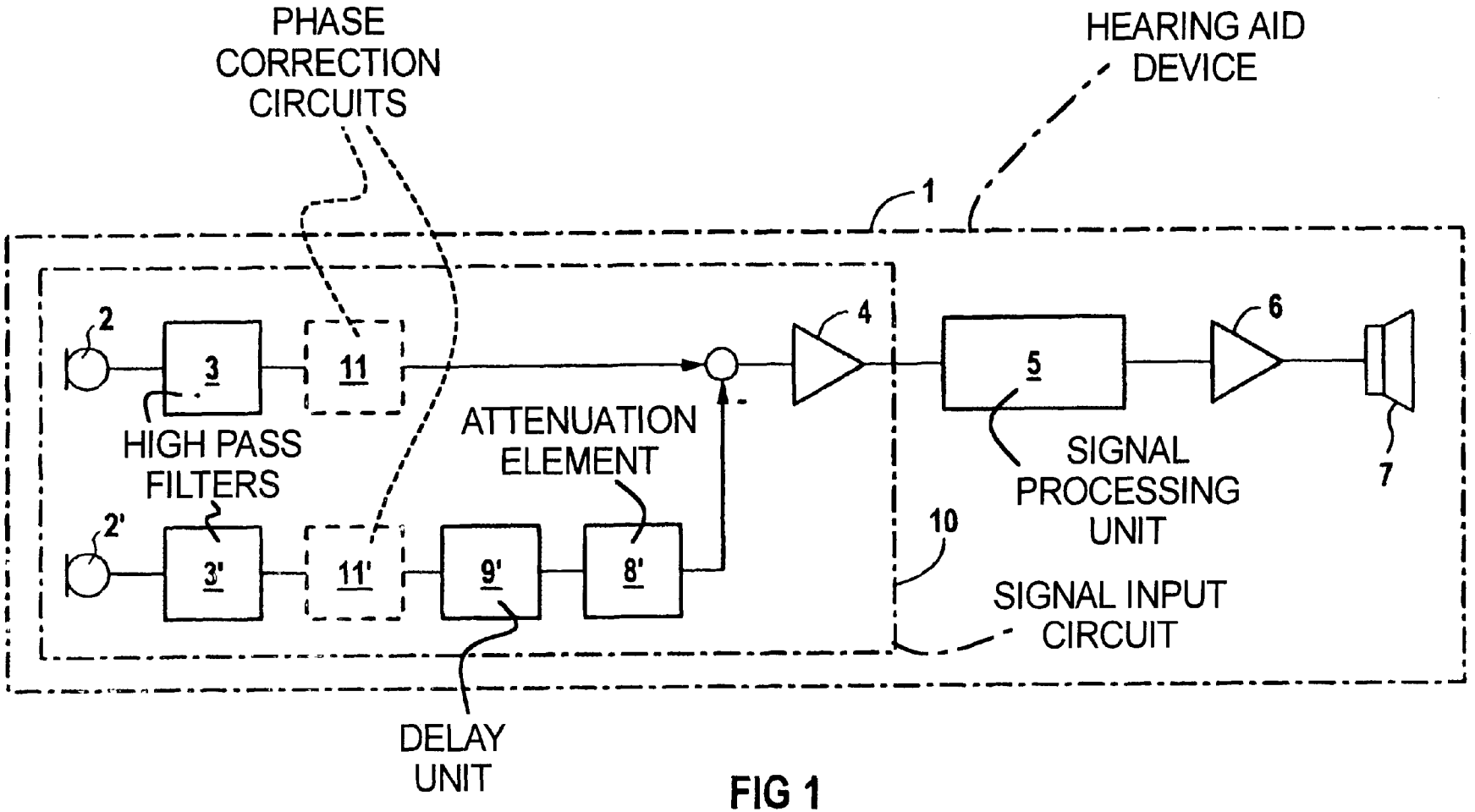
FIG 1 (PRIOR ART)
FIG. 1 is a block circuit diagram of a hearing aid device having two input transducers according to the prior art.

FIG. 1 is a block circuit diagram of a known hearing aid device 1 with two electroacoustic input transducers 2 and 2'. Following the input transducers 2 and 2' are two high-pass filters 3 and 3', respectively. To attain a directional microphone characteristic, the output signal of the microphone 2' is delayed by a signal delay unit 9 and subtracted from the output signal of microphone 2 by an attenuation element 8 provided with a corresponding weighting. The resulting difference signal is forwarded to a signal pre-amplifying unit 4. The actual analog and/or digital signal processing, not explained in detail herein, takes place in a signal processing unit 5. Subsequently the signal is amplified in a signal amplification unit 6 and forwarded to a receiver 7.

The part of the circuit characterized here as signal input circuit 10 produces a good directional microphone characteristic only if the two input transducers 2, 2', in the frequency range in which the directivity is to be attained, deviate no more than negligibly from one another in their amplitude response and/or phase response. A phase deviation of more than 3° already causes an unsatisfactory directional characteristic.

One option for matching the microphones to one another is to use only microphones that match each other exactly. Consequently, the best suited are selected from a number of microphones on the basis of manufacturing tolerances.

Another known option for allowing greater microphone tolerances is the insertion of specific correction circuits 11 or 11' into the signal paths of the input signals. Such circuits are, however, relatively complicated.

Figure 2:
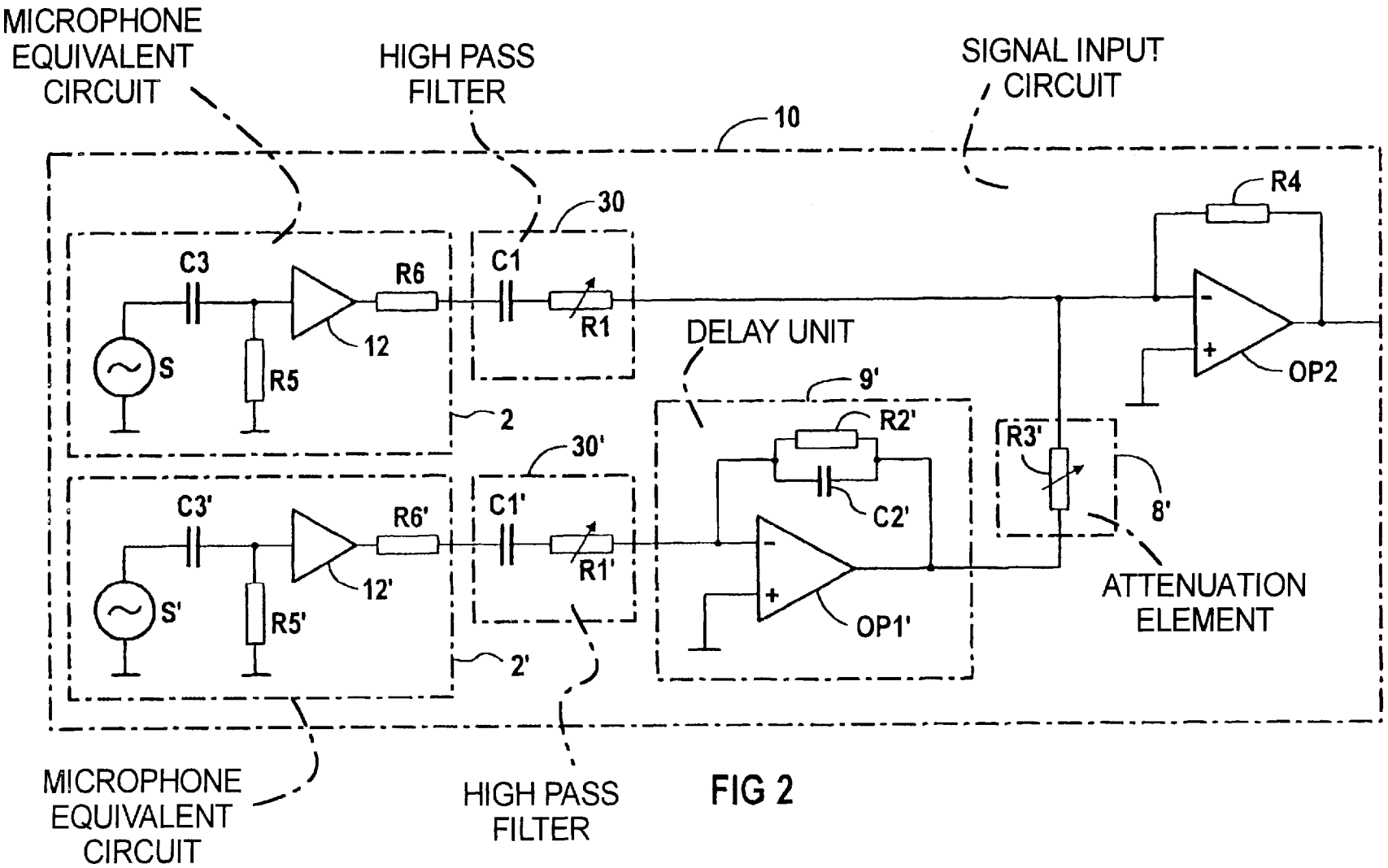
FIG. 2 is a circuit diagram of an exemplary embodiment of a hearing aid device having two transducers according to the invention.

An inventive signal input circuit 10 for a hearing aid device is illustrated in FIG. 2. This has two input signal paths. The first input signal path has an omnidirectional microphone 2 and a high-pass filter 30 subsequent thereto. The second signal path has an omnidirectional microphone 2', followed by a high-pass filter 30', a signal delay unit 9' and an attenuation element 8'.

The two microphones 2 or 2' each are illustrated by an equivalent circuit. The respective equivalent circuits include a signal source S or S', followed by a high-pass filter composed of a capacitor C3 or C3' and a resistor R5 or R5'. The illustrated high-pass filter approximately describes the response of the acoustic high-pass filter of a real microphone. The limit frequency of this acoustic high-pass filter is set by a small hole in the microphone membrane such that it lies on the magnitude of 100 Hz. The invention is, however, not limited to this value; rather, higher or lower values are possible as well. An impedance converter 12 or 12' as well as a microphone output resistor R6 or R6' follows the high-pass filter in the equivalent circuits of the respective microphones.

The two high-pass filters 30 and 30' subsequent to the two microphones 2 and 2' respectively contain a coupling capacitor C1 or C1' and a resistor R1 or R1'. This arrangement of a coupling capacitor and a resistor is a customary circuit for coupling a microphone signal into an amplifier circuit, e.g. of a hearing aid device. In accordance with the invention the two high-pass filters 30, 30' are matched in their limit frequencies to the limit frequencies of the preceding microphones in contrast to known circuits. For this purpose, in the exemplary embodiment, the values of the programmable resistors R1 and R1' are selected such that the limit frequency of the microphone 2 corresponds to the limit frequency of the high-pass filter 30' and the limit frequency of the microphone 2' corresponds to the limit frequency of the high-pass filter 30. Thus, in a simple manner, it is possible to balance manufacturing related variation of the limit frequencies of the microphones used.

The components of the exemplary embodiment shown in FIG. 2 can have the following exemplary numerical values. Assuming the respective limit frequencies $f_g$2 or $f_g$2' of the two microphones 2 and 2' deviate by 10% from their theoretical value of 100 Hz, so that $f_g$2=90 Hz, $f_g$2'=110 Hz, then the limit frequencies $f_g$30 and $f_g$30' of the two high-pass filters 30 and 30' are set such that $f_g$30 =110 Hz, $f_g$30'=90 Hz.

The values of the two resistors R1 and R1' are preferably changeable by programming for this purpose. Consequently, a significantly greater tolerance range is possible for the microphones 2 and 2' with respect to their limit frequencies than would be possible in a hearing aid device according to the prior art, unless complicated additional circuitry were used.

The values of the two resistors R1 and R1' determine not only the limit frequencies of the two high-pass filters 30 and 30', they also determine the weighting of the signals of the two paths given the subsequent addition and amplification. Since a change in the values of these resistors R1 and R1' also entails a change in the weighting, this must be brought about by adjusting the attenuation element 8'—in the form of a programmable resistor R3 in the exemplary embodiment—back to its original value.

The delay unit 9' in the embodiment of FIG. 2 is formed by an operational amplifier OP1' having a feedback path with an RC element therein, composed of a resistor R2' and a capacitor C2' connected in parallel with each other.

The output signal from the high-pass filter 30, and the delayed and attenuated output signal from the high-pass filter 30' are combined in an operational amplifier OP2, having a feedback resistor R4.

The values of the components of the exemplary embodiment can be as follows for the case $f_g2$=90 Hz, $f_g2'$=110 Hz:

| | |
|---|---|
| C1 = | 47 nF |
| C1' = | 47 nF |
| R1 = | 30.8 kΩ |
| R1' = | 37.6 kΩ |
| C2' = | 330 pF |
| R2' = | 52 kΩ |
| R3' = | 42.6 kΩ |
| R4 = | 300 kΩ |

Although modifications and changes may be suggested by those skilled in the art, it is the intention of the inventors to embody within the patent warranted hereon all changes and modifications as reasonably and properly come within the scope of their contribution to the art.

We claim as our invention:

1. A method for producing a directional microphone characteristic in a hearing aid, comprising the steps of:

receiving incoming audio signal with an omnidirectional first microphone, having a first microphone limit frequency, in a first signal path and filtering an output from said first microphone in a first high-pass filter, having an adjustable first high-pass filter limit frequency, in said first signal path, said first signal path having a first signal path output;

also receiving said incoming audio signals with an omnidirectional second microphone, having a second microphone limit frequency, in a second signal path, and filtering an output from said second microphone in a second high-pass filter, having an adjustable second high-pass filter limit frequency, in said second signal path, said second signal path having a second signal path output;

setting said first high-pass filter limit frequency to match said second microphone limit frequency and setting said second high-pass filter limit frequency to match said first microphone limit frequency;

combining and processing said first signal path output and said second signal path output to produce a processed signal representing a directional microphone characteristic; and converting said processed signal into an output audio signal in an output transducer.

2. A method as claimed in claim 1 wherein said first high-pass filter comprises a first resistor and a first capacitor, at least one of which is adjustable in value as a first value-variable component, and wherein said second high-pass filter comprises a second resistor and a second capacitor, at least one of which is adjustable in value as a second value-variable component, and wherein the step of setting said first high-pass filter limit frequency comprises adjusting said first value-variable component and wherein the step of setting said second high-pass filter limit frequency comprises adjusting said second value-variable component.

3. A method as claimed in claim 2 comprising adjusting said first value-variable component and said second value-variable component by programming.

4. A method as claimed in claim 1 comprising connecting an attenuation element in at least one of said first signal path and said second signal path, and attenuating the respective output signal of the signal path in which said attenuation element is connected.

5. A method as claimed in claim 4 comprising employing a programmable attenuation element as said attenuation element, and varying attenuation of the output signal in the signal path in which said programmable attenuation element is connected by programming said programmable attenuation element.

6. A hearing aid comprising:

an omnidirectional first microphone for receiving incoming audio signals and producing a first microphone output in a first signal path, said first microphone having a first microphone limit frequency;

a first high-pass filter connected in said first signal path connected in said first signal path to receive said first microphone output, said first high-pass filter having an adjustable first high-pass filter limit frequency and producing a first signal path output;

an omnidirectional second microphone also for receiving said incoming audio signals and producing a second microphone output in a second signal path;

a second high-pass filter connected in said second signal path to receive said second microphone output, said second high-pass filter having an adjustable second high-pass filter limit frequency and producing a second signal path output;

said first high-pass filter limit frequency being set to match said second microphone limit frequency and said second high-pass filter limit frequency being set to match said first microphone limit frequency;

at least one processing component connected to receive said first signal path output and said second signal path output and to combine and process said first and second signal path outputs to produce a processed signal representing a directional microphone characteristic; and an output transducer supplied with said processed signal for converting said processed signal into an output audio signal.

7. A hearing aid as claimed in claim 6 wherein said first high-pass filter comprises a first resistor and a first capacitor, at least one of which is adjustable in value as a first variable value component by which said first high-pass filter limit frequency is set, and wherein said second high-pass filter comprises a second resistor and a second capacitor, at least one of which is adjustable in value as a second variable-value component by which second high-pass filter limit frequency is set.

8. A hearing aid as claimed in claim 7 wherein said first variable-value component is adjustable by programming and wherein said second variable-value component is adjustable by programming.

9. A hearing aid as claimed in claim 6 further comprising an attenuation element having a variable attenuation factor connected in at least one of said first signal path and second signal path for attenuating the output signal of the signal path in which said attenuation element is connected.

10. A hearing aid as claimed in claim 9 wherein said attenuation factor or said attenuation element is adjustable by programming.

11. A hearing aid as claimed in claim 6 wherein said first high-pass filter comprises an adjustable first resistor and a capacitor, said first high-pass filter limit frequency being set by adjusting a value of said first resistor, and wherein said second high-pass filter comprises an adjustable second resistor and a second capacitor, and wherein said second high-pass filter limit frequency is set by adjusting a value of said second resistor.

12. A hearing aid as claimed in claim 11 further comprising an inverting signal delay circuit connected in one of said first signal path and said second signal path.

13. A hearing aid as claimed in claim 12 wherein said inverting signal delay unit comprises an operational amplifier having a feedback path with an RC element connected therein.

14. A hearing aid as claimed in claim 13 wherein said at least one component for combining and processing said first signal path output and said second signal path output comprises an operational amplifier having a feedback path containing a feedback resistor to which said first signal path output and said second signal path output are supplied.

15. A hearing aid as claimed in claim 12 further comprising an attenuation element with a variable signal attenuation factor connected in said one of said first signal path and said second signal path in which said inverting signal delay unit is connected.

16. A hearing aid as claimed in claim 15 wherein said attenuation element comprises an adjustable resistor and wherein said variable attenuation factor is set by changing a value of said adjustable resistor.

* * * * *